US012253337B2

(12) United States Patent
Surdu et al.

(10) Patent No.: US 12,253,337 B2
(45) Date of Patent: Mar. 18, 2025

(54) HYBRID TACTICAL ENGAGEMENT SIMULATION SYSTEM

(71) Applicant: By Light Professional IT Services LLC, McLean, VA (US)

(72) Inventors: John R. Surdu, Orlando, FL (US); Dirk Harrington, Orlando, FL (US); Jason Black, Orlando, FL (US); Anthony Lynch, Geneva, FL (US)

(73) Assignee: By Light Professional IT Services LLC, McLean, VA (US)

( * ) Notice: Subject to any disclaimer, the term of this patent is extended or adjusted under 35 U.S.C. 154(b) by 12 days.

(21) Appl. No.: 18/311,821

(22) Filed: May 3, 2023

(65) Prior Publication Data

US 2023/0408225 A1 Dec. 21, 2023

Related U.S. Application Data

(60) Provisional application No. 63/350,680, filed on Jun. 9, 2022.

(51) Int. Cl.
*F41G 3/26* (2006.01)

(52) U.S. Cl.
CPC ..... *F41G 3/2655* (2013.01)

(58) Field of Classification Search
CPC ..... G09B 9/003; F41G 3/2655
See application file for complete search history.

(56) References Cited

U.S. PATENT DOCUMENTS

2004/0033472 A1 2/2004 Varshneya
2009/0053679 A1* 2/2009 Jones ..... F41J 5/02 434/22
2010/0003991 A1 1/2010 Pao
2012/0183928 A1* 7/2012 Finlayson ..... F41J 5/02 398/115
2013/0130204 A1 5/2013 Lim
2015/0354922 A1 12/2015 Carriere
2015/0364053 A1* 12/2015 Quail ..... G09B 9/003 434/11

(Continued)

OTHER PUBLICATIONS

International Search Report and Written Opinion dated Jan. 19, 2024, directed to International Application No. PCT/US2023/020838; 15 pages.

*Primary Examiner* — Peter R Egloff
(74) *Attorney, Agent, or Firm* — Morrison & Foerster LLP

(57) ABSTRACT

A computing system for executing a simulation of a tactical engagement configured to receive a first set of data comprising an indication that a laser sensor worn by a participant was struck by a laser transmitted from a firearm; and receive a second set of data from the firearm comprising data generated by an image capture device of the firearm and an indication that one or more of the participants are present in the data. The computing system is further configured to retrieve data comprising position information and velocity information on the participants that are present in the second set of data. The computing system is further configured to identify a target participant from the participants identified in the second set of data; determine whether the target participant is struck by a simulated ammunition round fired from the firearm; and determine a final outcome for the tactical engagement.

22 Claims, 7 Drawing Sheets

(56) References Cited

U.S. PATENT DOCUMENTS

| | | | | |
|---|---|---|---|---|
| 2017/0307333 | A1 | 10/2017 | Northrup | |
| 2018/0159565 | A1* | 6/2018 | Armstrong | H04B 1/38 |
| 2019/0249955 | A1 | 8/2019 | Surdu | |

* cited by examiner

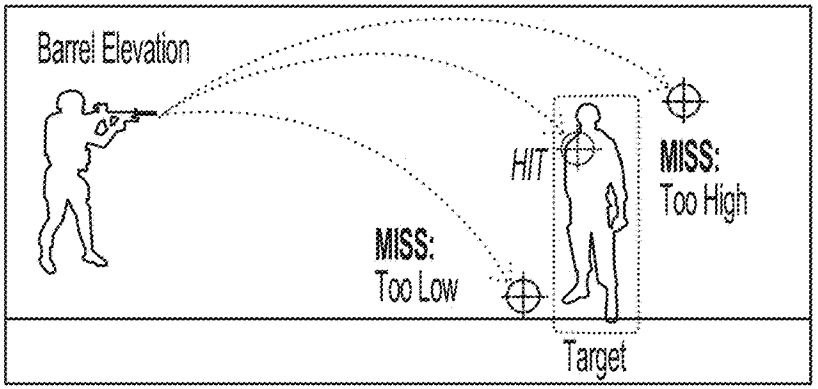
FIG. 3A
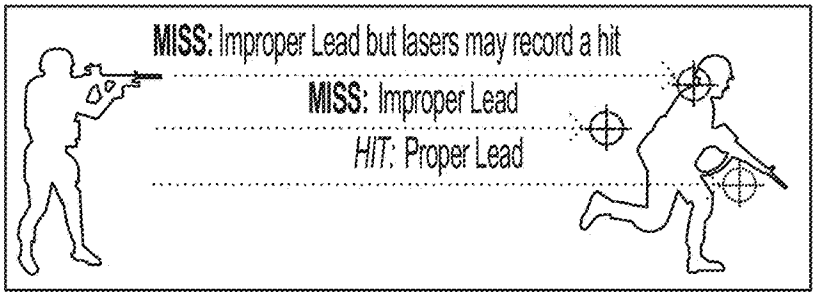
FIG. 3B
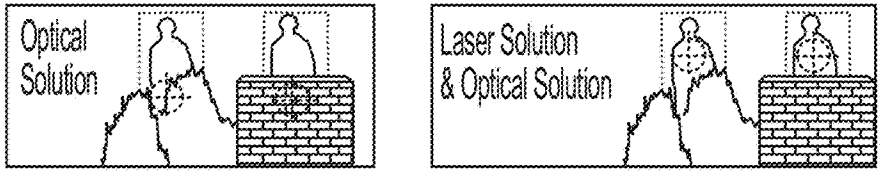
FIG. 3C
FIG. 3D
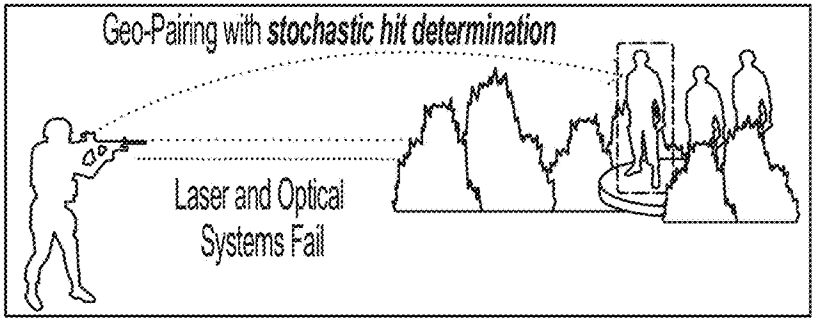
FIG. 3E
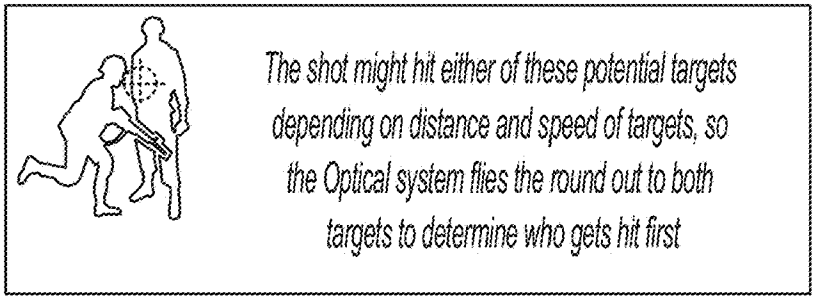
FIG. 3F

HYBRID TACTICAL ENGAGEMENT SIMULATION SYSTEM

CROSS-REFERENCE TO RELATED APPLICATIONS

This application claims the benefit of U.S. Provisional Application No. 63/350,680, filed Jun. 9, 2022, the entire contents of which is incorporated herein by reference.

FIELD

This disclosure generally relates to a tactical engagement simulation system and more specifically to an engagement simulation system that combines multiple engagement systems.

BACKGROUND

Military, security, and law enforcement personnel conduct training in order to experience and learn from mistakes prior to a "real world" event. Small arms and vehicle marksmanship training involves a mix of techniques, including firing live ammunition on a firearm range. An important training technique is live, force-on-force training. In such training, participants in a field environment employ tactics and their full range of firearm systems against each other. An important component of such training is proper employment of the trainees' firearms while reinforcing proper tactics, techniques, and procedures.

One approach employs laser emitters on the shooters' firearms and laser sensors on the targets. In laser engagement systems an emitter mounted on the firearm generates a laser signal when the firearm's trigger is pulled and a blank cartridge creates the appropriate acoustic, flash, and/or shock signature.

However, laser engagement systems suffer from a number of drawbacks. A first drawback is that they cannot be used to engage partially occluded targets, such as a target that is partially hidden behind a bush. Such terrain features would not stop an actual projectile, but do block lasers, causing participants to learn to incorrectly take cover behind terrain that would not stop a bullet. Additionally, proper marksmanship techniques involve aiming slightly ahead of or leading a moving target. However, laser engagement systems penalize participants for leading moving targets, as lasers ravel in a straight line and are nearly instantaneous. This causes participants to learn to incorrectly aim at the target, instead of ahead of it. Furthermore, bullets, as well as other projectiles from firearms such as grenade launchers, travel in a parabolic trajectory, as opposed to a straight line like lasers do. At different ranges, the bullet's trajectory may be above or below the line of sight, such that when firing at shorter ranges, the shooter may have to aim below the center of mass of the target, and at longer ranges, the shooter may have to aim above the center of mass. With laser engagement systems, employing these proper marksmanship techniques often results in incorrect misses being recorded.

A second approach employs optical technology to engage targets during live training. An optical system is aligned to the sights of the firearm for capturing the sight image at the time the trigger sensor is activated to provide image information about the aim point of the shooter participant's firearm. The captured image and participant information are forwarded to a server which simulates the engagement, which includes determining the shooter and target participants.

Optical engagement systems also suffer from drawbacks. As a maturing technology, optical engagement systems are not quite at a level to be able to fully support the requirements of live force-on-force training. Optical engagement systems also often rely on the accuracy of computer vision technology to find targets, or potential targets, in the captured sight images. However, various conditions in the training environment can interfere with the computer vision's ability to identify targets. Additionally, optical engagement systems computationally simulate the shots fired between participants. However, in cases such as with short range shots, the computation times of the computer vision in the optical engagement system end up being longer than the actual flight time of the bullets it is simulating. As a result, the simulation can diverge from the scenario it was meant to simulate, and the difference between the simulation and real scenario may not be negligible. There are also certain situations in which a laser engagement system may be more applicable than an optical engagement system.

A third approach employs a pairing method called geometric pairing, which uses a set of data about both the shooter and target, such as locations, weapon orientations, velocities, and nearby terrain to resolve engagements. The data is fed into algorithms that are used to pair a shooter with any potential targets. However, geometric pairing systems suffer from the drawback that the algorithms are not sufficiently faultless, as the values that are fed into the algorithms are sometimes not within the necessary degrees of errors. As a result, even though the initial variance in the values may not be noticeable compared with the real scenario, the scale of the engagement results in a variance that is large enough to change the outcome of the engagement.

SUMMARY

The examples disclosed herein are only examples, and the scope of this disclosure is not limited to them. Particular examples may include all, some, or none of the components, elements, features, functions, operations, or steps of the examples disclosed above. Examples according to the disclosure are in particular disclosed in the attached claims directed to a method, a storage medium, a system and a computer program product, wherein any feature mentioned in one claim category, e.g. method, can be claimed in another claim category, e.g. system, as well. The dependencies or references back in the attached claims are chosen for formal reasons only. However any subject matter resulting from a deliberate reference back to any previous claims (in particular multiple dependencies) can be claimed as well, so that any combination of claims and the features thereof are disclosed and can be claimed regardless of the dependencies chosen in the attached claims. The subject-matter which can be claimed comprises not only the combinations of features as set out in the attached claims but also any other combination of features in the claims, wherein each feature mentioned in the claims can be combined with any other feature or combination of other features in the claims. Furthermore, any of the examples and features described or depicted herein can be claimed in a separate claim and/or in any combination with any example or feature described or depicted herein or with any of the features of the attached claims.

The present disclosure describes a tactical engagement simulation system that retains the benefits of various existing engagement systems while reducing the negative drawbacks present in the systems individually. The various existing engagement systems may be attached to each of the firearms used in the simulation, where each of the engagement systems may operate as they normally do when utilized individually. Whenever a participant in the simulation fires their firearm, the engagement systems on the firearm may be activated and generate data about the engagement. The data from each of the engagement systems may be transmitted to a remote server that handles the processing to adjudicate an outcome for the engagement. The processing may include various operations such as identifying which of the simulation participants is the target of the engagement and simulating the effect of firing a real ammunition round from the firearm. The results of the operations may enable the remote server to determine the most appropriate final outcome for the engagement.

In one or more examples, a computing system for executing a simulation of a tactical engagement comprises: a memory, and one or more processors, wherein the memory stores one or more programs that when executed by the one or more processors, cause the one or more processors to: receive a first set of data comprising an indication that a laser sensor worn by one of a plurality of participants in the simulation was struck by a laser transmitted from a firearm of a plurality of firearms, wherein each firearm of the plurality of firearms is associated to a participant of the plurality of participants; receive a second set of data from the firearm of the plurality of firearms where the laser was transmitted from, wherein the second set of data comprises data generated by an image capture device of the firearm, wherein the data includes an indication that one or more of the plurality of participants are present in the data; retrieve, from a data storage, a third set of data comprising position information and velocity information on the one or more of the plurality of participants that are present in the second set of data; identify a target participant from the one or more of the plurality of participants identified in the second set of data, wherein identifying the target participant is based on the third set of data; determine whether the target participant is struck by a simulated ammunition round fired from the firearm, wherein the determination is based on the third set of data; and determine a final outcome for the tactical engagement, wherein the determination is based on comparing the indication that the laser sensor was struck by the laser, the determination on whether the target participant is struck by the simulated ammunition round, and the determination on whether the second target participant is struck by the simulated ammunition round to one another and determining which is most accurate for a predefined scenario that the tactical engagement is in.

Optionally, the one or more programs when executed further cause the one or more processors to receive a fourth set of data comprising position information and orientation information of the firearm.

Optionally, the target participant is identified from the plurality of participants in the simulation using the third set of data and the fourth set of data, wherein the third set of data comprises position information and velocity information on each of the plurality of participants in the simulation.

Optionally, identifying the target participant from the plurality of participants comprises identifying one of the plurality of participants with a highest probability of being the target participant based on the third set of data and the fourth set of data.

Optionally, the one or more programs when executed further cause the one or more processors to make a second determination on whether the target participant is struck by the simulated ammunition round is based on a stochastic process using the third and fourth set of data to determine a likelihood that the target participant is struck by the simulated ammunition round.

Optionally, the final outcome of the tactical engagement is determined by determining a first likelihood that the laser sensor being struck by the laser is a correct outcome for the predefined scenario that the tactical engagement is in, a second likelihood that the determination of whether the target participant is struck by the simulated ammunition round is the correct outcome for the predefined scenario, and a third likelihood that the second determination of whether the target participant is struck by the simulated ammunition round is the correct outcome for the predefined scenario, wherein the final outcome is determined based on which of the first and second likelihoods is greater.

Optionally, a first set of steps used to determine the first likelihood, a second set of steps used to determine the second likelihood, and a third set of steps used to determine the third likelihood are stored into the data storage.

Optionally, the final outcome of the tactical engagement is stored into the data storage.

Optionally, the determination of whether the target participant is struck by the simulated ammunition round fired from the firearm is stored into the data storage.

Optionally, the one or more programs when executed further cause the one or more processors to determine an amount of damage done to the target participant if the target participant is determined to be struck by the simulated ammunition round.

Optionally, the simulated ammunition round is simulated by determining a trajectory of a live round when fired from the firearm.

Optionally, the first set of data further comprises information on when the laser was transmitted from the firearm.

Optionally, the first set of data further comprises information that identifies the firearm where the laser was transmitted from.

Optionally, the first set of data further comprises information on where the laser sensor is located on the body of the one of the plurality of participants.

Optionally, the one or more programs when executed further cause the one or more processors to periodically receive data about each of the plurality of participants.

Optionally, the received data about each of the plurality of participants is stored into the data storage.

Optionally, the one or more programs when executed further cause the one or more processors to transmit the final outcome to one or more of the plurality of participants.

Optionally, the indication, of the second set of data, that one or more of the plurality of participants are present in the data is determined by using computer vision.

Optionally, the second set of data comprises data generated by a passive sensor.

Optionally, identifying the target participant is further based on the first set of data.

In one or more examples, a method for executing a simulation of a tactical engagement comprises: receiving a first set of data comprising an indication that a laser sensor worn by one of a plurality of participants in the simulation was struck by a laser transmitted from a firearm of a plurality of firearms, wherein each firearm of the plurality of firearms is associated to a participant of the plurality of participants; receiving a second set of data from the firearm of the plurality of firearms where the laser was transmitted from, wherein the second set of data comprises data generated by an image capture device of the firearm, wherein the data includes an indication that one or more of the plurality of participants are present in the data; retrieving, from a data storage, a third set of data comprising position information and velocity information on the one or more of the plurality of participants that are present in the second set of data; identifying a target participant from the one or more of the plurality of participants identified in the second set of data, wherein identifying the target participant is based on the third set of data; determining whether the target participant is struck by a simulated ammunition round fired from the firearm, wherein the determination is based on the third set of data; and determining a final outcome for the tactical engagement, wherein the determination is based on comparing the indication that the laser sensor was struck by the laser, the determination on whether the target participant is struck by the simulated ammunition round, and the determination on whether the second target participant is struck by the simulated ammunition round to one another and determining which is most accurate for a predefined scenario that the tactical engagement is in.

Optionally, the method further comprises receiving a fourth set of data comprising position information and orientation information of the firearm.

Optionally, the target participant is identified from the plurality of participants in the simulation using the third set of data and the fourth set of data, wherein the third set of data comprises position information and velocity information on each of the plurality of participants in the simulation.

Optionally, identifying the target participant from the plurality of participants comprises identifying one of the plurality of participants with a highest probability of being the target participant based on the third set of data and the fourth set of data.

Optionally, the method further comprises making a second determination on whether the target participant is struck by the simulated ammunition round is based on a stochastic process using the third and fourth set of data to determine a likelihood that the target participant is struck by the simulated ammunition round.

Optionally, the final outcome of the tactical engagement is determined by determining a first likelihood that the laser sensor being struck by the laser is a correct outcome for the predefined scenario that the tactical engagement is in, a second likelihood that the determination of whether the target participant is struck by the simulated ammunition round is the correct outcome for the predefined scenario, and a third likelihood that the second determination of whether the target participant is struck by the simulated ammunition round is the correct outcome for the predefined scenario, wherein the final outcome is determined based on which of the first and second likelihoods is greater.

Optionally, a first set of steps used to determine the first likelihood, a second set of steps used to determine the second likelihood, and a third set of steps used to determine the third likelihood are stored into the data storage.

Optionally, the final outcome of the tactical engagement is stored into the data storage.

Optionally, the determination of whether the target participant is struck by the simulated ammunition round fired from the firearm is stored into the data storage.

Optionally, the method further comprises determining an amount of damage done to the target participant if the target participant is determined to be struck by the simulated ammunition round.

Optionally, the simulated ammunition round is simulated by determining a trajectory of a live round when fired from the firearm.

Optionally, the first set of data further comprises information on when the laser was transmitted from the firearm.

Optionally, the first set of data further comprises information that identifies the firearm where the laser was transmitted from.

Optionally, the first set of data further comprises information on where the laser sensor is located on the body of the one of the plurality of participants.

Optionally, the one or more programs when executed further cause the one or more processors to periodically receive data about each of the plurality of participants.

Optionally, the received data about each of the plurality of participants is stored into the data storage.

Optionally, the method further comprises transmitting the final outcome to one or more of the plurality of participants.

Optionally, the indication, of the second set of data, that one or more of the plurality of participants are present in the data is determined by using computer vision.

Optionally, the second set of data comprises data generated by a passive sensor.

Optionally, identifying the target participant is further based on the first set of data.

In one or more examples, a non-transitory computer readable storage medium storing one or more programs for executing a simulation of a tactical engagement by one or more processors of a remote computing device that when executed by the device, cause the device to: receive a first set of data comprising an indication that a laser sensor worn by one of a plurality of participants in the simulation was struck by a laser transmitted from a firearm of a plurality of firearms, wherein each firearm of the plurality of firearms is associated to a participant of the plurality of participants; receive a second set of data from the firearm of the plurality of firearms where the laser was transmitted from, wherein the second set of data comprises data generated by an image capture device of the firearm, wherein the data includes an indication that one or more of the plurality of participants are present in the data; retrieve, from a data storage, a third set of data comprising position information and velocity information on the one or more of the plurality of participants that are present in the second set of data; identify a target participant from the one or more of the plurality of participants identified in the second set of data, wherein identifying the target participant is based on the third set of data; determine whether the target participant is struck by a simulated ammunition round fired from the firearm, wherein the determination is based on the third set of data; and determine a final outcome for the tactical engagement, wherein the determination is based on comparing the indication that the laser sensor was struck by the laser, the determination on whether the target participant is struck by the simulated ammunition round, and the determination on whether the second target participant is struck by the simulated ammunition round to one another and determining which is most accurate for a predefined scenario that the tactical engagement is in.

Optionally, the programs when executed by the device further cause the device to receive a fourth set of data comprising position information and orientation information of the firearm.

Optionally, the target participant is identified from the plurality of participants in the simulation using the third set of data and the fourth set of data, wherein the third set of data comprises position information and velocity information on each of the plurality of participants in the simulation.

Optionally, identifying the target participant from the plurality of participants comprises identifying one of the plurality of participants with a highest probability of being the target participant based on the third set of data and the fourth set of data.

Optionally, the programs when executed by the device further cause the device to make a second determination on whether the target participant is struck by the simulated ammunition round is based on a stochastic process using the third and fourth set of data to determine a likelihood that the target participant is struck by the simulated ammunition round.

Optionally, the final outcome of the tactical engagement is determined by determining a first likelihood that the laser sensor being struck by the laser is a correct outcome for the predefined scenario that the tactical engagement is in, a second likelihood that the determination of whether the target participant is struck by the simulated ammunition round is the correct outcome for the predefined scenario, and a third likelihood that the second determination of whether the target participant is struck by the simulated ammunition round is the correct outcome for the predefined scenario, wherein the final outcome is determined based on which of the first and second likelihoods is greater.

Optionally, a first set of steps used to determine the first likelihood, a second set of steps used to determine the second likelihood, and a third set of steps used to determine the third likelihood are stored into the data storage.

Optionally, the final outcome of the tactical engagement is stored into the data storage.

Optionally, the determination of whether the target participant is struck by the simulated ammunition round fired from the firearm is stored into the data storage.

Optionally, the programs when executed by the device further cause the device to determine an amount of damage done to the target participant if the target participant is determined to be struck by the simulated ammunition round.

Optionally, the simulated ammunition round is simulated by determining a trajectory of a live round when fired from the firearm.

Optionally, the first set of data further comprises information on when the laser was transmitted from the firearm.

Optionally, the first set of data further comprises information that identifies the firearm where the laser was transmitted from.

Optionally, the first set of data further comprises information on where the laser sensor is located on the body of the one of the plurality of participants.

Optionally, the programs when executed by the device further cause the device to periodically receive data about each of the plurality of participants.

Optionally, the received data about each of the plurality of participants is stored into the data storage.

Optionally, the programs when executed by the device further cause the device to transmit the final outcome to one or more of the plurality of participants.

Optionally, the indication, of the second set of data, that one or more of the plurality of participants are present in the data is determined by using computer vision.

Optionally, the second set of data comprises data generated by a passive sensor.

Optionally, identifying the target participant is further based on the first set of data.

BRIEF DESCRIPTION OF THE FIGURES

FIGS. 3A-3F depict visual representations of exemplary engagement types according to examples of the disclosure.

DETAILED DESCRIPTION

Examples of the present disclosure may enable more accurate simulations of live, force-on-force, tactical engagement training to be performed efficiently using various existing engagement systems. Using examples of the present disclosure, the advantages of existing engagement systems may be maintained while many of the negative training effects that are introduced by each of the existing engagement systems individually may be mitigated. Coupled with how there may be valid use cases in which one technology is more advantageous than another, examples of the present disclosure may demonstrate the ability of engagement systems to cover for each other's gaps, provide more accurate engagement resolution, and degrade performance gracefully.

The present disclosure is directed mostly to more accurately adjudicating the simulation outcome for a specific instance or occurrence of an engagement between a shooter and a target. References herein to "an engagement" or "the engagement" thus refer to a specific engagement instance that just involves a shooter firing their firearm at some number of targets. However, in a real tactical engagement simulation employing an example of the present disclosure, the volume of engagement instances may be very high. This may be because participants in the simulation may be constantly firing at one another, and each time a firearm is fired may correspond with a distinct engagement instance with distinct data. However, the present disclosure may apply to each of the engagement instances in a real simulation, and may be scaled using any appropriate approaches known in the art.

The following description is presented to enable a person of ordinary skill in the art to make and use the various examples. Descriptions of specific devices, techniques, and applications are provided only as examples. Various modifications to the examples described herein will be readily apparent to those of ordinary skill in the art, and the general principles defined herein may be applied to other examples and applications without departing from the spirit and scope of the various examples. Thus, the various examples are not intended to be limited to the examples described herein and shown, but are to be accorded the scope consistent with the claims.

Figure 1:
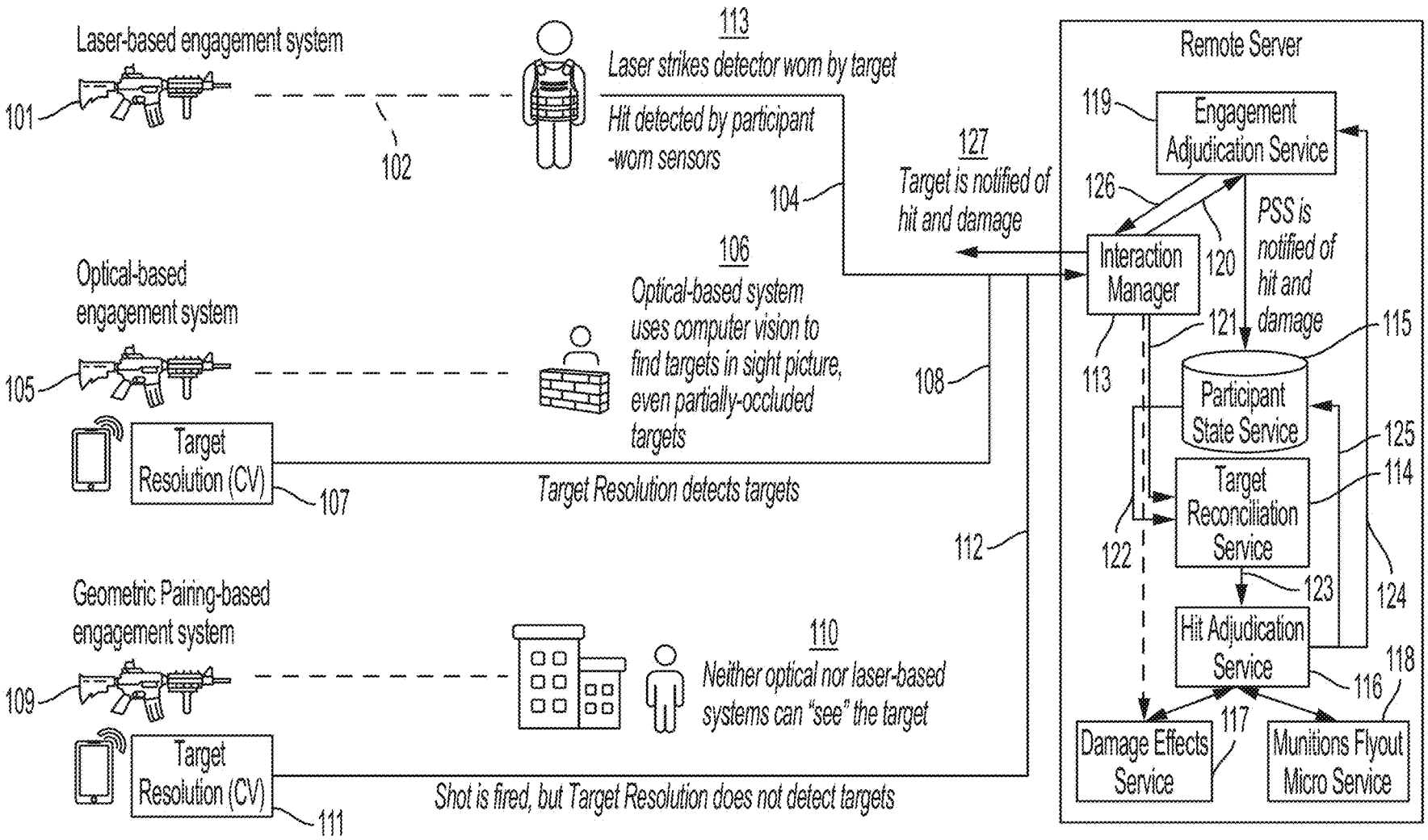
FIG. 1 depicts an overview of an exemplary tactical engagement simulation system according to examples of the disclosure.

FIG. 1 depicts an overview of an exemplary tactical engagement simulation system according to the present disclosure. A laser-based engagement system 101 may be attached to each of the firearms used in the tactical engagement simulation. The laser engagement system 101 may comprise an emitter mounted on the firearm that generates a laser 102 when activated. The laser engagement system 101 may be activated in any number of ways, such as connecting the laser engagement system to the trigger of the firearm such that the laser engagement system generates the laser 102 when the trigger is pulled. The laser 102 may simulate an ammunition round being fired from the firearm, while a blank cartridge may create the appropriate acoustic, flash, and/or shock signature. The laser 102 may also encode information about the shooting firearm, such as the orientation of the firearm, data to uniquely identify the firearm that generated the laser, or data on when the laser was transmitted.

Each of the participants in the engagement simulation may be fitted with a laser sensor 103 capable of detecting the laser 102 generated by the laser engagement system 101. A participant's laser sensor detecting the laser may simulate the participant being hit by an ammunition round, and a separate alarm also worn by the participant may be connected to the laser sensor to notify the participant that they have been hit. Data 104 regarding the hit may then be generated and sent to the remote server. The data 104 may contain various different information pertaining to the hit. For example, the data may specify the hit location on the participant. If the laser sensor that detected the laser was located on the participant's shoulder, the information may specify that the participant was hit in the shoulder. The data may also comprise the information encoded in the laser 102 that uniquely identifies the firearm where the laser originated from and when the laser was transmitted from the firearm.

The laser engagement system 101 may need to always transmit data to the remote server if a hit is recorded, but the engagement system may not always need to transmit data if a hit is not recorded. More specifically, if the laser 102 is never detected by a laser sensor 103, the fact that the laser engagement system recorded a miss for the engagement may not need to be actively transmitted to the remote server. Granted, actively transmitting a recorded miss may be one approach. However, the fact that a miss was recorded may also be conveyed to the remote server by simply not transmitting any data. In such an approach, the remote server may be configured to infer the fact that the laser engagement system recorded a miss from the fact that no data was received from the laser system for the engagement. A major advantage of not transmitting data for a miss event may be a significant reduction in overall bandwidth requirement, as many shots in a live simulation may likely not hit a target, so not sending data from the laser engagement system for all of those engagements may greatly reduce the number of necessary data transmissions.

An optical-based engagement system 105 may also be attached to each of the firearms, in addition to the laser system 101. When activated, the optical engagement system 105 may capture a sight picture 106 which may subsequently be used to identify potential targets within the sight picture. The sight picture may be a digital representation of a shooter's view through the firearm's sight when the trigger is pulled. An image capture device 240, which may use active or passive sensing, may be attached to the firearm that is aligned with the barrel and sights of the firearm such that the sight picture captured by the device is an accurate representation of the shooter's view when the trigger is pulled. A computing device 230 attached to the firearm may perform target resolution 107 to identify any potential targets that may be in the sight picture by applying one or more computer vision algorithms to the sight picture 106. The specific computer vision algorithm used may differ based on the situation, such as certain environmental conditions or image quality of the sight picture. Once the computer vision algorithm has finished, data 108 comprising the sight picture and the results of the target resolution may be transmitted to the remote server for further processing in order to adjudicate the final outcome of the engagement captured in the sight picture. Before transmitting the data 108, the optical engagement system may perform some preprocessing of the captured sight picture in order to reduce bandwidth requirements. The preprocessing may include cropping the picture, reducing the resolution, compressing the picture, adjusting the tint, hue, saturation, or other attributes of the picture.

Similar to the laser engagement system, the optical engagement system 105 may need to always transmit data to the remote server if any number of potential targets are identified in the sight picture 106, but may not always need to transmit data if no potential targets are identified in the sight picture. This is because the remote server may be configured to infer the fact that no potential targets were identified simply based on not receiving any data from the optical engagement system for an engagement. However, not transmitting data to the remote server in such cases may only work if the remote server does not otherwise depend on the data from the optical engagement system. For example, if the remote server is only configured to need the data to identify the potential targets and nothing else, then it may be appropriate to not transmit any data when there is no information to provide on potential targets. However, if in addition to data on potential targets, the remote server is configured to also need the sight picture to, for example, extract necessary terrain information, then data may still need to be transmitted from the optical engagement system even if no potential targets are identified.

A geometric pairing-based engagement system 109 may also be attached to each of the firearms, in addition to the laser engagement system 101 and optical engagement system 105. In certain scenarios, neither the laser engagement system 101 nor the optical engagement system 105 can "see" a target 110, as the target may be completely occluded by an object or a part of the terrain. As such, a laser 102 may be blocked by the object or terrain, and target resolution using computer vision 111, 107 may not detect any potential targets in the sight picture. In such scenarios, the geometric pairing engagement system 109 may generate and transmit certain data 112 to the remote server that may subsequently be used to mathematically simulate ammunition being fired from the firearm, in order to accurately simulate engagements where some participant is hit by ammunition even though they were not readily visible from the shooter's perspective. This may be the case for any number of reasons, such as the target resolution simply failing to identify potential targets even though they are actually in the sight picture and thus would be hit, or because participants are positioned behind something like foliage that prevents the laser 101 and optical 105 engagement systems from recording hits even though participants would actually be hit in the presence of live ammunition rounds. The data 112 that is generated and then transmitted to the remote server may include data on the location of the firearm that was fired, the orientation of the firearm, and/or the contents of nearby terrain. The data 112 may include everything that the remote server absolutely needs in order to adjudicate an outcome for the engagement, and this may be what enables the other two engagement systems to not have to transmit data in the appropriate cases, i.e. when the laser system 101 records a miss and the target resolution 107 does not identify any potential targets. The data 112 may later be fed into mathematical algorithms that are used to pair a shooter with potential targets to simulate the engagement between the shooter and targets.

The geometric pairing engagement system may also allow for the present disclosure to be equally applicable to simulations involving high-trajectory or non-line of sight shooting firearms. Due to the particular nature of how such weapons are supposed to be used, the firearms may never be aimed directly at targets, which means the laser from the laser engagement system may never be detected by the laser sensors, and similarly, the barrel and sights of the firearm may not be aimed at the target, so no participants may be captured in the sight picture of the optical engagement system. Since the geometric pairing engagement system does not rely on the laser of sight picture, it may cover for those shortcomings and allow the simulation to support the high-trajectory firearms.

In various examples, the geometric pairing engagement system 109 may be configured such that the data 112 is always generated and transmitted to the remote server regardless of whether it is needed or not, and instead, have the remote server decide how to handle the data. This configuration may be advantageous as it lessens the computational burden on the geometric pairing engagement system's end where it may not be appropriate or realistic to include the processing power to make such computations during a simulation, and instead offload the necessary computation to the remote server where it may be more appropriate to perform the computation to decide whether the data 112 is needed to adjudicate the outcome of the engagement. Alternatively, the geometric pairing engagement system 109 may be configured to monitor the laser and optical engagement systems 101, 105 and to generate the data 112 only when necessary, i.e. when the laser engagement system records a miss and the target resolution 107 of the optical engagement system does not identify any potential targets. This configuration may be advantageous by lessening the bandwidth requirement at least with respect to the geometric pairing engagement system. Assuming most engagements may be accurately simulated using just the data from the laser and/or optical engagement systems, this configuration may greatly reduce the amount of data that must be transmitted to the remote server in any simulation.

The three engagement systems may also be implemented in different combinations in various examples. A first example may comprise all three of the engagement systems which may allow such an example to have access to the various benefits provided by each engagement systems and use all three to adjudicate tactical engagements. Alternatively, various examples may only comprise some pair of the three engagement systems, such as only comprising the laser and optical systems, only comprising the laser and geometric pairing systems, or only comprising the optical and geometric pairing systems. In examples where only a pair of engagement systems are implemented, the functionalities of the remote server as described further herein may need to be appropriately adjusted to only operate with the engagement systems that are implemented.

Although the three engagement systems may be implemented completely separately from one another, overlaps in the engagement systems may mean it is less than optimal to have the engagement systems completely separate of one another. For example, both the optical 105 and geometric pairing 109 engagement systems utilize target resolution 107, 111 in the process of generating the data 108, 112 that is transmitted to the remote server. The target resolution 107, 111 between the two engagement systems may perform largely, if not entirely, similar operations, so it may be inefficient to have the target resolution duplicated between the two engagement systems. Additionally, the geometric pairing engagement system 109 in various examples where data 112 may only transmitted based on the results of the other engagement systems as mentioned above may need to communicate with the other engagement systems. Thus, as an alternative, various examples may introduce some extent of integration between the engagement systems.

Figure 2:
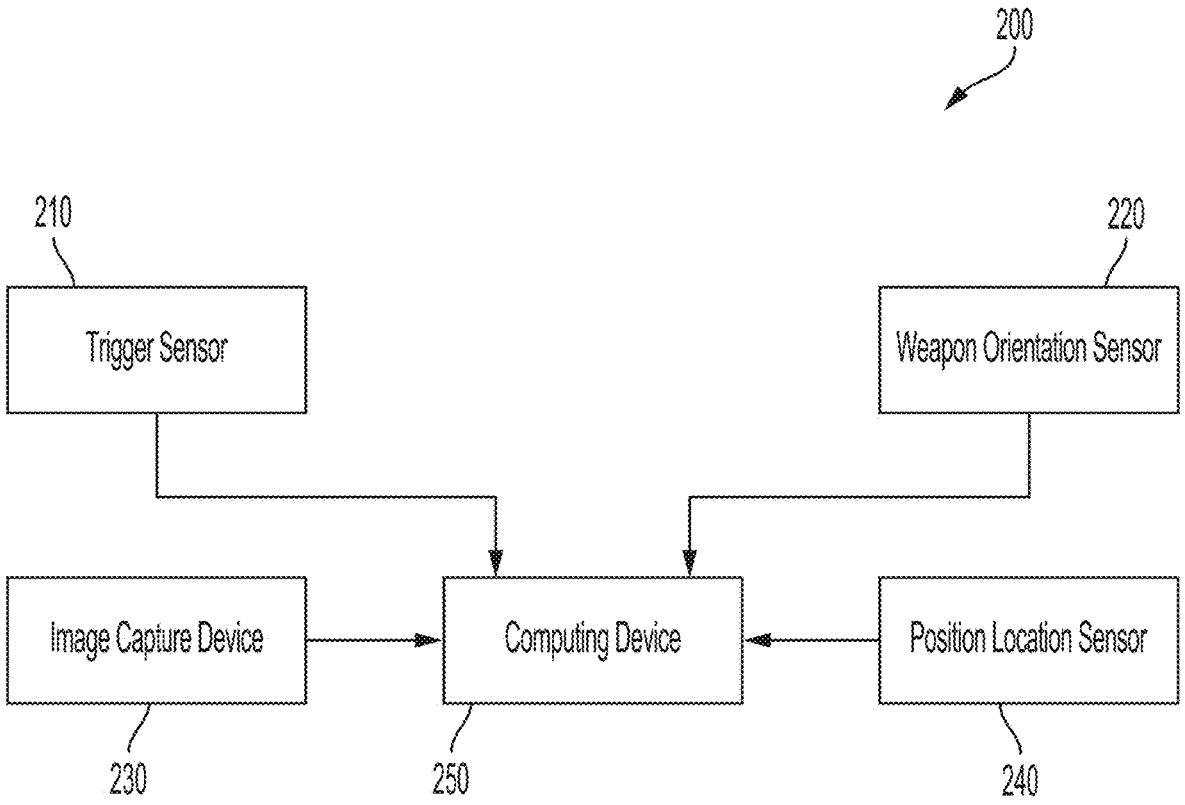
FIG. 2 depicts an exemplary configuration of components used by the engagement systems of the simulation system according to examples of the disclosure.

FIG. 2 depicts an exemplary configuration where components may be shared across the three engagement systems. A trigger sensor 210 may synchronize and simultaneously activate the engagement systems. This may be necessary as the engagement data captured by the three engagement systems may later be used for accurate engagement outcome adjudication. If the three engagement systems diverge substantially in the data they provide regarding the engagement, the inconsistencies may greatly complicate the process of adjudicating the final outcome of the engagement. As a result, the determined outcome of the engagement may be insensible and disturb the flow of the training simulation, or be incorrect and lead to negative training results for participants, among many potential other problems. The image capture device 230, which may use active or passive sensing, may be primarily associated with the optical engagement system and, as mentioned above, may be aligned with the sights of the firearm to capture a sight picture of the shooter's view when the trigger sensor 210 is pulled. The image capture device may also capture one or more sight pictures, or other forms of imagery data, such as 1) some mix of visible spectrum, non-visible spectrum, and multi-spectrum images, 2) video image or a series of still images, 3) images from a single viewpoint or multiple viewpoints, 4) images from narrow and wide-angle viewpoints. The sight picture captured by the image capture device may be sent to the computing device 250, which may then execute the computer vision algorithms to identify any potential targets in the sight picture. The computing device 250 may also be shared with the laser engagement system 101 as it may be responsible for transmitting the data 104 for the engagement system. By having the geometric pairing engagement system 109 also share the computing device 250, the engagement system may efficiently determine whether to generate its corresponding data 112. Upon detecting that no potential targets were identified in the optical engagement system 105 and the laser engagement system 101 recorded a miss, a query may be sent to the weapon orientation sensor 220 and position location sensor 240. The weapon orientation sensor 220 may provide data on the firearm's orientation at the time the engagement systems are activated, while the position location sensor 240 may provide data on the position, orientation, and speed of the firearm and/or the participant carrying the firearm. In this way, the necessary functionality of each of the engagement systems may be supported while optimizing for any overlap and/or interactions necessary between the engagement systems. It should be noted, however, that this is an arbitrary example and many other system structures may also be appropriate.

The remote server may receive the three sets of data 104, 108, and 112 from the laser-based engagement system 101, the optical-based engagement system 105, and the geometric pairing-based engagement system 109, respectively, via the interaction manager 113. Upon receiving the incoming data, the interaction manager may route the data to various other parts of the remote server. The interaction manager may first route the laser system data 104 along 120 from the laser engagement system directly to the Engagement Adjudication Service (EAS) 119. The interaction manager may route the optical engagement system data 108 along 121 to the Target Reconciliation Service (TRS) 114 where the data 108 may be used for additional processing. The interaction manager may also route the laser system data 104 and geometric pairing engagement system data 112 along 121 to the TRS for additional processing in the cases where it may be necessary in various examples. The interaction manager 113 may also transmit various data 127, such as the final outcome for the engagement, from the remote server back to one or more of the participants and/or firearms. The interaction manager 113 may also periodically receive various data about each of the participants in the simulation, which may be used to help determine a final outcome of the engagement as discussed further herein. Whenever updated participant data is received, it may be stored in the Participant State Service 115 where it may be retrieved by other components as needed. The participant data may include various information, such as the participant's position, velocity, and orientation, among many others. The participant data may be generated using some of the components from the engagement systems, such as the weapon orientation sensor 220 being used to identify the participant's orientation and the position location sensor 240 being used to identify the participant's position. Alternatively, or additionally, each of the participants may be fitted with their own set of components for generating such information, such as a GPS sensor for position, an accelerometer for velocity, and a gyroscope for orientation. However, these are arbitrary designations and many other approaches to generating the participant data may be appropriate.

The Target Reconciliation Service 114 may use the engagement data it received from the interaction manager to identify which participant is the target in the engagement. When identifying the target based on the optical engagement system data 108, the TRS may identify the target out of the participants already determined to be in the sight picture as a result of the target resolution 107. As part of identifying the target, the Target Reconciliation Service may retrieve additional data, such as the position and velocity of the participants at the time of the engagement, from the Participant State Service 115, which may be a data storage configured to store various data, as discussed further herein. The TRS may integrate the engagement data with the additional participant data to identify the target.

The Target Reconciliation Service may follow a similar approach when identifying the target based on the geometric pairing engagement data 112. In this case, because the target resolution 107, 111 was not able to identify any participants in the sight picture, the target may need to be identified out of all the participants in the simulation, instead of a smaller subset. As such, the TRS may retrieve additional data such as the position and velocity of every one of the participants in the simulation at the time of the engagement from the Participant State Service 115. This additional data may then be integrated with the geometric pairing engagement system data 112 which may include the location and orientation of the firearm in order to probabilistically determine which participant is most likely to be the target of the engagement.

In various examples, the Target Reconciliation Service may leverage the laser engagement system data 104 as an aid in identifying the target. As the laser system data may already comprise an indication that one of the simulation's participants has been struck by the laser simulating the ammunition round, that fact may provide a foundation for the Target Reconciliation Service in determining the target from the optical system data and/or the geometric pairing system data.

The Target Reconciliation Service may also identify multiple targets, instead of just a single target. This may allow the TRS to identify targets in cases where multiple targets may be hit in the engagement, helping to make the overall simulation more accurate. This may be the case if participants are positioned in such a way that an ammunition round would graze one or more participants before squarely hitting a target, or the type of ammunition routinely used has piercing properties and would thus hit multiple participants who may be overlapping each other. Additionally, ammunition routinely used in some firearms may explode, hitting any entity that may be within a burst radius. By enabling the TRS to identify multiple targets, the present disclosure may be applicable to all the mentioned scenarios.

Once the target of the engagement has been identified, the Target Reconciliation Service may determine various additional facts regarding the engagement. For example, the distance from the shooting firearm to the identified target may be calculated using position information in the received engagement data 108, 112 and the position data of the target retrieved from the Participant State Service 115. The additional facts may also include terrain information. The terrain information may be extracted from the sight picture data of the received engagement data 108, or retrieved from a persistent terrain database which is prepopulated prior to the start of the simulation session. The persistent terrain database may be integrated with the Participant State Service 115 or it may be a separate database. The identified target, data about the target, and additional facts regarding the engagement may then all be sent from the Target Reconciliation Service 114 to the Hit Adjudication Service (HAS) 116. It may be appreciated that the noted additional facts are arbitrary, and various other facts may be appropriate.

The Hit Adjudication Service 116 may determine whether the target is struck by a simulated ammunition round using the various data received from the Target Reconciliation Service 114. The Hit Adjudication Service 116 may query a Munitions Fly-out Micro Service 118 in order to construct the simulated ammunition round that is fired from the firearm of the engagement. The Munitions Fly-out Micro Service 118 may be a ballistic kernel configured to reflect the type of firearm presently in use in the simulation, and may be replaced and/or reconfigured to reflect different types of firearms. The micro service 118 may simulate the ammunition round by calculating the trajectory of an ammunition round fired from the firearm given the orientation of the firearm and the type of the firearm. The trajectory may be adjusted based on any number of factors, such as the rise and fall of a round over its travel distance, atmospheric effects, weather, wind, interactions with the terrain, and any other factors as required to accurately simulate the trajectory of the round. The trajectory of the round may then be returned to the Hit Adjudication Service 116.

The Hit Adjudication Service 116 may integrate the trajectory of the ammunition round with the information regarding the target and terrain information received from the Target Reconciliation Service 114 to determine whether the simulated ammunition round would hit the target. For example, the Hit Adjudication Service 116 may extrapolate the target's position in the near future based on the target's velocity, and if the extrapolated position intersects with the trajectory of the round, the Hit Adjudication Service may determine that the target is hit by the round. In such cases when the target would be hit by the simulated ammunition round, the Hit Adjudication Service may then query a Damage Effects Service 117 to predict the wounds that the target would sustain. The determination on whether the simulated ammunition round hits or misses the target and any damage that is sustained by the target on a hit may all be sent to the Participant State Service 115 for record keeping.

The Damage Effects Service 117 may use various data about the simulated round to predict the target's sustained wounds, such as the simulated round's terminal velocity when its trajectory intersects with the target, the caliber of a corresponding real round that would be fired from the firearm, the target's posture and orientation, the impact point, and whether the target is wearing any body armor. The extent of the wounds may include whether the wound is minor, major or fatal, the location of the wound, and any other aspects that may be appropriate for various examples.

The hit or miss determination of the Hit Adjudication Service 116 may be passed to the Engagement Adjudication Service 119 which makes a final determination on the outcome of the simulated engagement based on the determination received from the Hit Adjudication Service 116 and the laser engagement system data 104 that the EAS received directly from the interaction manager 113 via 120. The Engagement Adjudication Service may also use terrain data to help make the final determination, which may be received from the Hit Adjudication Service 116 or retrieved from a separate terrain database, as mentioned earlier. Using these sets of data, the EAS may identify the type of engagement that is currently being adjudicated, and based on what the type of engagement is, determine whether the hit or miss information in the laser engagement system data 104 or the hit or miss determination by the Hit Adjudication Service 116 would be the most appropriate outcome for the engagement.

TABLE 1

| Number | Use Case | Optical | Lasers | Geometric Pairing | Discussion |
|---|---|---|---|---|---|
| 1 | Short-range shots (<50 m) [A] | S | P | T | The error on deflection and elevation are not enough to significantly perturb the hit/miss calculation, so the laser may provide the answer |
| 2 | Longer-range shots [A] | P | S | T | Shooters must properly elevate the rifle based on target range. The optical system considers the rise and fall of the round over distance. If the image processing fails to find a target in the sight picture, default to the laser |
| 3 | Proper lead of moving targets [B] | P | S | T | Laser systems may still register hits even with improper lead. Optical system only credits for a hit when properly leading the target. If the image processing fails to find a target in the sight picture, default to the laser |
| 4 | Partial Occlusion [C] | P | S | T | Determine if the round impacts the bounding box of the target, regardless of occlusion. If the round is within the bounding box but in the occluded area, determine if the occlusion can stop a bullet (either with image processing and classification or with the terrain database). If a bullet can pass through the occlusion and is within the bounding box drawn by the optical system, record the shot as a "hit." If the image processing fails to find a target in the sight picture, default to the laser |
| 5 | Partial Occlusion [D] | S | P | T | The Laser system provides the correct answer on exposed body regions. |
| 6 | Blind through Concealment or due to low-light conditions or obscurants [E] | N/A | N/A | P | The Laser does not register a hit, because it cannot "see" the target. The Optical System cannot find a target in the sight picture. Use Geometric pairing to fly out the round as if the locations of players and orientation of the weapon was correct. Use a stochastic method (die roll) to determine if any entities near the line of fire of the round might be unlucky enough to get hit, as you would in a Constructive Simulation. |
| 7 | Blind Fire through Cover [E] | N/A | N/A | P | The Laser does not register a hit, because it cannot "see" the target. The Optical System cannot find a target in the sight picture. Use Geometric pairing to fly out the round as if the locations of players and orientation of the weapon was correct. If the rounds intersect terrain that will stop a bullet, the shot is a "miss." |

TABLE 1-continued

| Number | Use Case | Optical | Lasers | Geometric Pairing | Discussion |
|---|---|---|---|---|---|
| 8 | Closely Grouped Targets [F] | P | S | T | Fly the rounds out to all targets close to the aim point. Determine if any are hit. If the targets are too close together to distinguish, default to laser for hit determination |

Table 1 depicts a number of exemplary engagement types that the Engagement Adjudication Service 119 may use to determine the final outcome of the engagement. Each engagement type may have a primary P determinant that the final outcome is usually based on, a secondary S determinant that may be defaulted to as a backup if necessary, and a tertiary T determinant that may be used as a last resort if the primary P and secondary S determinants both fail, or may be used to enhance the primary P and secondary S determinants. It may be noted the engagement types described in Table 1 are not exhaustive and that many other engagement types may be possible, including engagement types that may be a combination of those listed in Table 1. FIGS. 3A-3F depict visual representations of the engagement types described in Table 1.

In a first engagement type that involves short-range shots of up to 50 meters, the primary determinant may be the data 104 received for the laser engagement system 101 as shots fired at such distances may be accurately simulated by the straight lines of lasers, and errors on deflection and elevation are not enough to significantly affect hit and/or miss calculations. On the other hand, in a second engagement type where the engagement involves longer-range shots, determining an outcome based on the laser engagement system data 104 may no longer be as appropriate since shots fired at such distances no longer travel in completely straight lines from the barrel of a firearm to a target like lasers do. In such cases, shooters must properly elevate the firearm based on target range in order to account for the rise and fall of the ammunition round over the distance to the target. The operations performed by the Hit Adjudication 116 and Munitions fly-out 118 services based on the optical engagement system data 108 more accurately takes such factors into consideration, and is thus able to provide a more accurate outcome. The secondary laser engagement system data 104 may be defaulted to if the target resolution of the optical engagement system simply fails to find any targets in the sight picture. In both engagement types, the geometric pairing system data 112 may be the tertiary determinant which may act as a final resort to ensure the remote server is able to provide an outcome for the engagement in case an outcome is unable to be determined based on just the optical and laser system data. Additionally, the geometric pairing system data may act as a supplement to either the optical or laser system data to enable the remote server to provide a more accurate outcome. FIG. 3A depicts a visual representation of the second engagement type involving longer-range shots. As shown in FIG. 3A, the elevation of the barrel in conjunction with the distance to the target may determine if a target is hit by an ammunition round. As shown in FIG. 3A, if the barrel is elevated too high or too low with respect to the distance to the target, the resulting trajectory of the ammunition round may not intersect with the target's position, resulting in misses. Only a barrel elevation that accurately accounts for the rise and fall of an ammunition round over the distance to the target may result in a hit on the target.

A third engagement type may involve a moving target instead of a stationary target, which may require a shooter to properly lead the target in order to record a hit. This would make a laser less than optimal as the almost instantaneous arrival of the laser at the target may largely preclude the need to properly lead the target as would be necessary with live rounds. On the other hand, the Hit Adjudication 116 and Munitions fly-out 118 services may estimate the positions of the target and simulated ammunition round over time in order to determine whether a shooter led the moving target properly such that the round arrives at the target's position at the right time to record a hit. As such, the hit-or-miss determination of the Hit Adjudication Service 116 based on the optical engagement system data 108 may be the primary determinant for this engagement type, while the laser engagement system data may be defaulted to if the target resolution 107 fails to identify any potential targets in the sight picture. Once again, the geometric pairing system data may be a tertiary option to protect against the failure of both the primary and secondary determinants to provide an outcome and/or to supplement the primary and secondary determinants to provide a more accurate outcome. FIG. 3B depicts a visual representation of this engagement type. As shown in FIG. 3B, aiming directly at the target or slightly behind where the target is moving to would be improperly leading the target and would result in a miss when using live rounds, but the instantaneous travel of lasers may still record a hit regardless. Instead, properly leading the target by aiming slightly in front of where the target is moving to would more accurately simulate real results, and is something that may be better simulated using the optical engagement system.

A fourth engagement type may involve a partially occluded target where the firearm may be aimed at the occlusion that is partially occluding the target. This may cause the laser from the laser engagement system to hit the occlusion and would likely prevent the laser sensors on the target from detecting the laser, resulting in the laser engagement system recording a miss regardless of what the occlusion was. This may not be completely accurate, as depending on what the occlusion is, a live round may be able to pierce through the occlusion and hit the target. For example, although an occlusion like a brick wall or a thick tree would block a round and prevent the target from being hit, other occlusions like foliage would likely not be able to block a live round, and the target would be hit. Since a laser may be blocked by any occlusion, the laser engagement system may not be able to accurately simulate such engagements. On the other hand, the optical engagement system data 108 may help simulate the nuances of such engagements, as the Hit Adjudication Service may first determine a hit or miss based on the data assuming a live round is able to pierce through the occlusion, and then the Engagement Adjudication Service may make the final determination of whether the occlusion is something a live round could pierce. A final outcome for the engagement may then be determined by affirming or reversing the Hit Adjudication Service's determination based on whether the occlusion could be pierced. The determination on whether the round would be able to pierce through the occlusion may rely on terrain data, which may be extracted from the same data 108 used by the Hit Adjudication Service with image processing, or may be retrieved from the separate terrain database as mentioned earlier. If the occlusion is determined to be something that a live round would be able to pierce through, like foliage, the final outcome may be determined as the target being hit. If instead the occlusion is determined to be something that a live round likely would not be able to pierce, like a brick wall, the final outcome may be determined as a miss. Similar to the previously discussed engagement types, the laser engagement data 104 may be defaulted to if the target resolution 107 of the optical engagement system fails to identify any potential targets in the sight picture. Once again, the geometric pairing system data may be a tertiary option to protect against the failure of both the primary and secondary determinants to provide an outcome and/or to supplement the primary and secondary determinants to provide a more accurate outcome. FIG. 3C depicts a visual representation of this engagement type, where the firearm is aimed at the target through the occlusion. As shown in FIG. 3C, the occlusion may be a bush, which would likely result in the target being hit as a round would likely pierce through the bush, or the occlusion may be a brick wall, which would likely result in the target not being hit as a round would likely not be able to pierce through the brick wall.

A fifth engagement type may also involve a partially occluded target, but the firearm may be aimed directly at the portion of the target that is not being occluded. In this case, the laser 102 from the laser engagement system 101 would not always report misses as it would not intersect with the occlusion. In such cases, the primary determinant of the final outcome may return to the first two engagement types. If the engagement involves only short range shots, the laser engagement system result may be taken as the primary determinant, while the calculations of the Hit Adjudication using the optical system's engagement data may be the primary determinant when the engagement involves longer-range shots. In both cases, the geometric pairing system data may be a tertiary option to protect against the failure of both the primary and secondary determinants to provide an outcome and/or to supplement the primary and secondary determinants to provide a more accurate outcome. FIG. 3D depicts a visual representation of this engagement type, where the firearm is aimed at the visible portion of the target. Since the occlusion would not interfere with hit determinations of either the laser or optical engagement systems, either may be the primary determinant in determining the final outcome.

A sixth and seventh engagement type may be cases where neither the laser system nor the optical system may be relied upon in determining the final outcome of an engagement. Such cases may arise in engagement instances where all of the participants being shot at are completely concealed from sight by some sort of occlusion or any sort of obscurant such as low-light conditions, when a shooter is blindly firing their firearm without actually specifically aiming at any participant in particular, or when the type of firearm necessitates indirectly shooting at targets with high-trajectory shots. The laser engagement system 101 may not provide reliable results as the laser would either hit the occlusion and result in misses being recorded even if a hit should be recorded to accurately simulate the ability of live rounds to pierce the occlusion, or because the laser would not be able to simulate the high-trajectory shots required of the specific kind of firearm. The optical engagement system also may not be reliable as there may not be any participants that are readily identifiable in the sight picture even though they may still be in the line of fire, either through the occlusion or at the end of the flight path of the high-trajectory round. As such, the determination from the Hit Adjudication Service based on the geometric pairing based engagement system 109 may become the most reliable method and thus the primary, if not only, method of determining the final outcome. Since the engagement data 112 from the geometric pairing system and the corresponding determination of hit/miss by the Hit Adjudication Service do not rely on any participants being "visible" from the perspective of the shooting firearm, the proper results of such engagement types may still be supported in the simulation. A stochastic process using the geometric pairing system data may determine whether any participants may be in the line of fire or within a general area that the simulated round may be fired towards and thus struck by the simulated round. FIG. 3E depicts a visual representation of an engagement where a shooter is shooting at completely occluded targets. As shown in FIG. 3E, the laser and optical engagement systems would fail in such a case as both are unable to "see" the targets and would likely inaccurately record misses, even though a live round would be able to pierce through the foliage and hit the targets. Because the geometric pairing engagement system is not affected by the occlusion between the shooter and target, it may be relied upon to accurately determine the outcome of the engagement. Stochastic hit determination based on the generated data about the shooter's firearm and data on the positions of the participants may be made for whether a participant is hit by the simulated ammunition round without regard to the occlusion that is concealing the participant. The ultimate determination of the engagement outcome may be made by the Engagement Adjudication Service after considering the hit determination in light of the foliage occlusion in the path of the ammunition round.

An eighth engagement type may involve multiple participants that are grouped closely together when the shot is fired. Specifically, these engagement types may comprise those where multiple participants are close enough together that they start overlapping one another from the perspective of the shooter. The optical engagement system may remain as the primary determinant for the final outcome as the target resolution 107 may be able to identify the overlapping participants as potential targets, and the Target Reconciliation Service 114 subsequently identifying multiple targets out of the potential targets. The Hit Adjudication Service 116 and Munitions Fly-out service 118 may then simulate rounds being fired towards all of the identified targets with multiple targets being hit as a result. In the more extreme cases where participants are so overlapped with one another that the target resolution 107 and/or the Target Reconciliation Service 114 are not able to accurately identify targets and/or the subsequent hit or miss determination by the Hit Adjudication Service 116 no longer makes much sense, the determination of the final outcome may default to the first participant that was struck by the laser of the laser engagement system. Once again, the geometric pairing system data may be a tertiary option to protect against the failure of both the primary and secondary determinants to provide a final outcome and/or to supplement the primary and secondary determinants to provide a more accurate outcome. FIG. 3F depicts a visual representation of the engagement type involving closely grouped targets. If a firearm is aimed and shot at the indicated position in example F, it may be very likely that both of the targets are hit in some way depending on the distance of the potential targets from where the ammunition round originated from and the speed that the potential targets are traveling at. Based on the data from the optical engagement system, both of the participants may be identified as targets, where rounds are then flown out to both of them to determine who is hit first, or if both of them are hit. By recognizing this engagement type, the Engagement Adjudication Service 119 may be able to accurately determine the outcome of such an engagement.

As mentioned earlier, after determining the engagement type, the Engagement Adjudication Service 119 may determine whether the hit or miss information in the laser engagement system data 104 or the hit or miss determination by the Hit Adjudication Service 116, which may include determinations based on both the optical and geometric pairing system data in examples where the geometric pairing system data supplements the optical system data as described above, would be the most appropriate outcome for the engagement type. One approach for determining the final outcome may be to first determine a weight for each of the results on how much to weigh their input in determining an outcome or a likelihood that their result is the accurate result for the engagement type. The weight/likelihood may be influenced by which result is the primary determinant based on something like Table 1, or the weight/likelihood may simply be what determines what the primary, secondary, and potentially tertiary determinant is in Table 1. Either way, the result associated with the higher or highest weight or likelihood may then be selected as the final outcome of the engagement. More specifically, the greater of a first and second weight/likelihood may be used in examples that mostly rely on just a primary and secondary determinant while generally leaving out the tertiary determinant unless needed; and the greatest of a first, second, and third weight/likelihoods may be used in examples where the tertiary determinant is generally considered along with the primary and secondary determinants as a supplement to provide a more accurate outcome. It may be noted this approach for determining the final outcome is arbitrary, and any other approach may also be appropriate. Once the final outcome has been determined, the final outcome may be transmitted to the interaction manager 113 via 126 in order to be transmitted to the participants. The final outcome, as well as the weights/likelihoods that were used to help determine the final outcome, may also be sent to the Participant State Service 115 to be stored so that the determinations may be analyzed at a later time.

Figure 4:
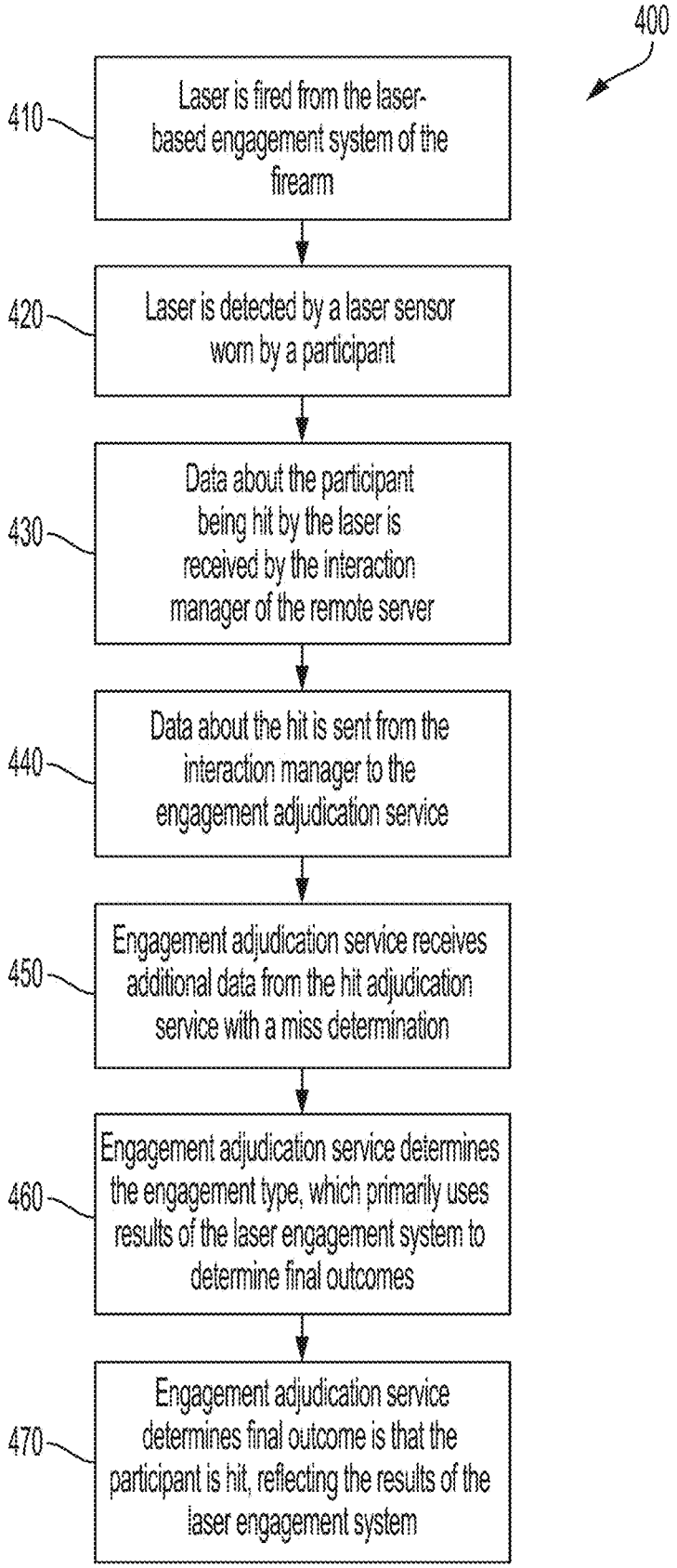
FIG. 4 depicts an exemplary engagement adjudication process that is primarily based on a laser-based engagement system according to examples of the disclosure.

FIG. 4 depicts a flowchart with an exemplary engagement adjudication process where the results of the laser engagement system are the primary determinant of the engagement's final outcome. Starting at 410, the laser engagement system on the firearm may fire a laser. As mentioned earlier, the laser may simulate an ammunition round fired from the firearm, and may be activated by the participant interacting with a trigger sensor that simulates pulling the trigger of a real firearm with live rounds. At 420, the laser may be detected by a laser sensor that is worn by one of the simulation participants. Each of the participants may be wearing a single large laser sensor covering most of their bodies, or the participants may be wearing multiple smaller sensors spread out across their bodies, but any other system of sensors may be appropriate in various examples. The laser being detected by any laser sensor may simulate a participant being struck by an ammunition round. At 430, data that the participant has been hit by the laser may be sent to the Interaction Manager of the remote server. Besides receiving the data, the Interaction Manager may perform some preprocessing to clean and/or reorganize the data it just received. At 440, the data may be sent from the Interaction Manager to the Engagement Adjudication Service to be used in determining the final outcome of the engagement that just happened. At 450, the Engagement Adjudication Service may receive a miss determination from the Hit Adjudication Service. This means the Hit Adjudication Service determined the participant that was hit by the laser would actually not be hit by a simulated ammunition round based on additional data received from either the optical or geometric pairing engagement systems regarding the same engagement that the laser engagement system data was for. At 460, the Engagement Adjudication Service may determine the type of engagement that the participants were involved in. The type of engagement may involve selecting the most likely engagement type from a set of predefined types, such as those introduced in Table 1, based on various information such as terrain data and participant data, however this is an arbitrary designation and various other approaches may be appropriate. For this particular example, it should be noted that whatever approach is used to determine the engagement type, it may be assumed that the determined engagement type primarily uses results from the laser engagement system in determining the final outcome of the engagement. This may mean, for example, the engagement type is determined to be, or involve, short-range shots up to 50 meters (case 1 of Table 1). Lastly at 470, the Engagement Adjudication Service may determine the final outcome of the engagement is that the participant is hit, which reflects the increased weight given to the laser engagement system results, even if it may contradict the Hit Adjudication Service's results.

Figure 5:
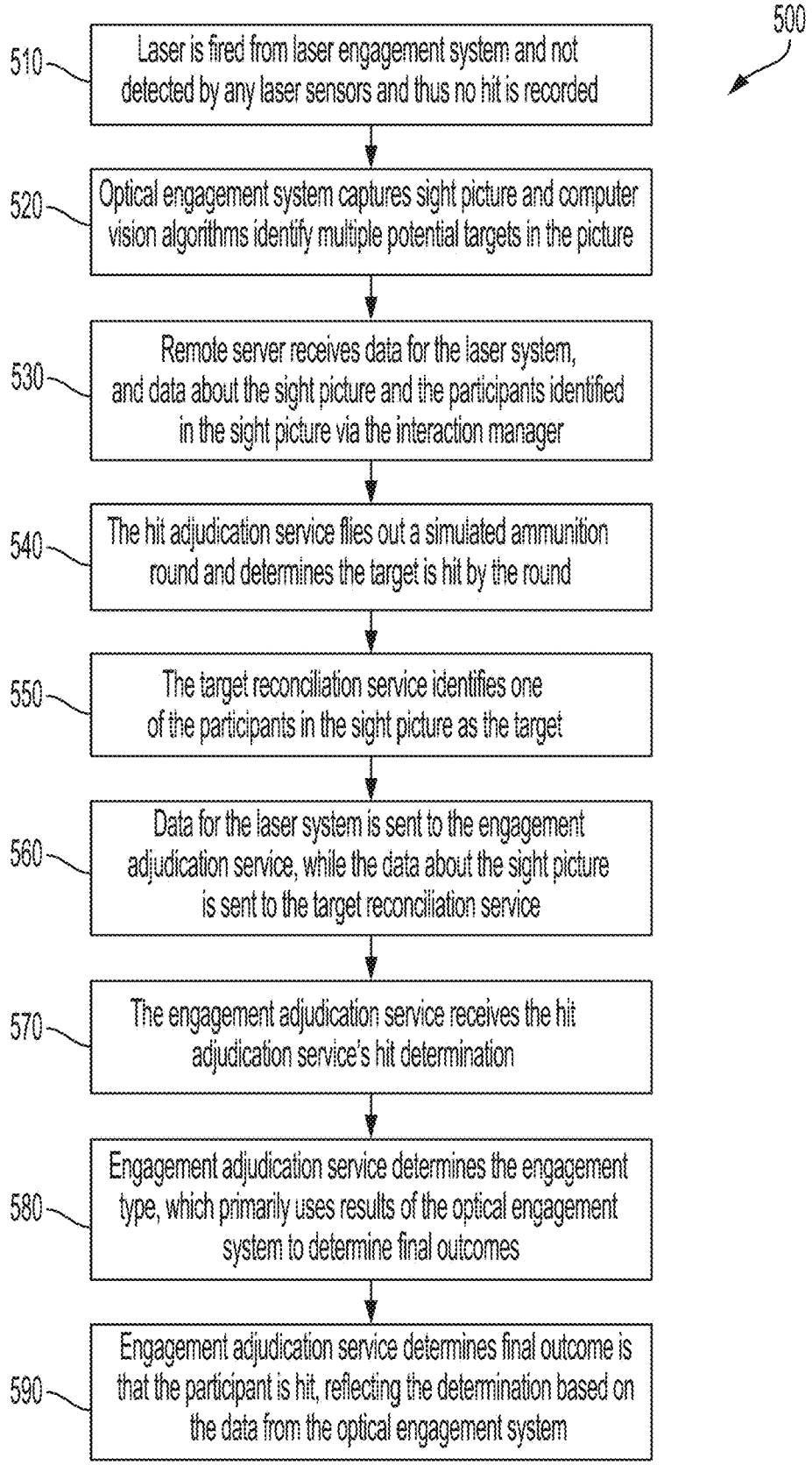
FIG. 5 depicts an exemplary engagement adjudication process that is primarily based on an optical-based engagement system according to examples of the disclosure.

FIG. 5 depicts a flowchart with an exemplary engagement adjudication where the optical engagement system is the primary determinant of an engagement's final outcome. Starting at 510, a laser fired from the laser engagement system may be fired but not detected by any laser sensor worn by the participants, meaning no hit is recorded by the laser engagement system. At 520, the optical engagement system may capture a sight picture of the engagement using the image capture device, and then apply computer vision algorithms in order to identify multiple potential targets in the picture. At 530, the data from the laser engagement system and the sight picture along with the results of the computer vision from the optical engagement system may all be transmitted to and then received by the Interaction Manager of the remote server. At this point, it should be noted that this specific example assumes that instances where the laser misses a target are actively reported to the remote server. However, as mentioned earlier, various examples of the present disclosure may also be configured to not send anything to the server from the laser engagement system if the laser misses, and if the server does not receive data from the laser engagement system, the remote server may be configured to realize that means the laser engagement system recorded a miss for the engagement. At 540, the laser system data may be sent directly to the Engagement Adjudication Service, while the optical engagement system data may be sent to the Target Reconciliation Service. At 550, the Target Reconciliation Service identifies one of the potential targets in the sight picture as the target of the engagement. At 560, the Hit Adjudication Service simulates an ammunition round and determines that the round will hit the identified target. At 570, the Engagement Adjudication Service receives the hit determination from the Hit Adjudication Service. At 580, the Engagement Adjudication Service may determine the type of engagement that the participants were involved in. For this particular example, it may be assumed that the determined engagement type primarily uses results from the optical engagement system in determining the final outcome of the engagement. This may mean, for example, the engagement type is determined to be, or involve, longer-range shots (case 2 of Table 1). Lastly at 590, the Engagement Adjudication Service determines the final outcome of the engagement is that the participant is hit, which reflects the increased weight given to the optical engagement system results, even if it may contradict the data received from the laser engagement system.

Figure 6:
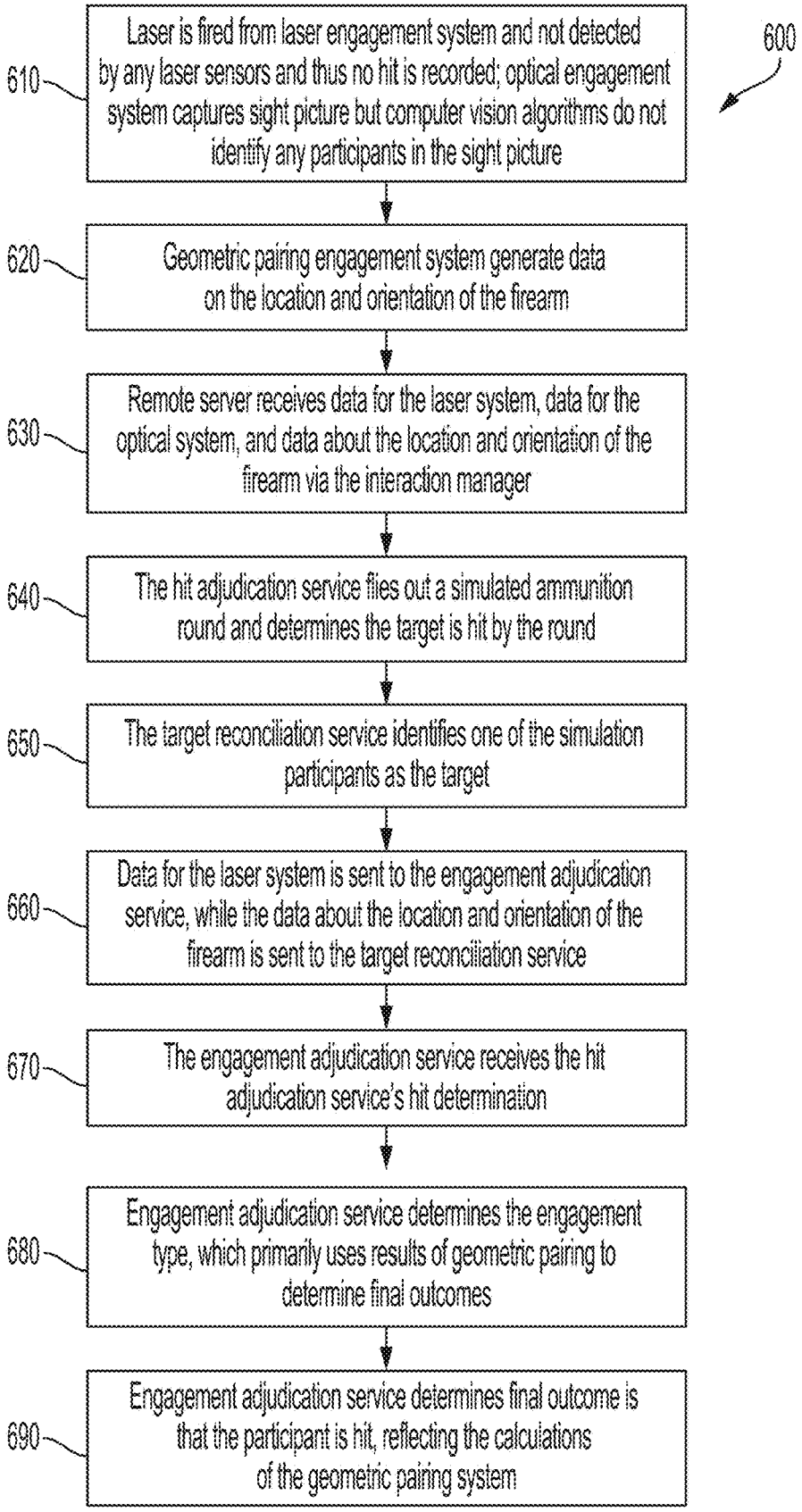
FIG. 6 depicts an exemplary engagement adjudication process that is primarily based on a geometric pairing-based engagement system according to examples of the disclosure.

FIG. 6 depicts a flowchart with an exemplary engagement adjudication where the geometric pairing engagement system is the primary determinant of an engagement's final outcome. Starting at 610, a laser fired may be from the laser engagement system but not detected by any laser sensor worn by the participants, meaning no hit is recorded. Additionally, the optical engagement system may capture a sight image, but the computer vision algorithms fail to identify any potential targets in the sight image. At 620, the geometric pairing engagement system generates data on the location and orientation of the firearm. Recall that the geometric pairing engagement system may be configured to monitor the other engagement systems and only generate data when it senses both of the other engagement systems fail to record a hit, or alternatively, the geometric pairing system may be configured to always generate data for an engagement and have the remote server decide whether to use the generated data. In this particular example, it may be assumed that either configuration may be applied, even though the steps may suggest that the former configuration is applied. At 630, the data from the laser engagement system, the data from the optical engagement system, and the data generated by the geometric pairing system may all be transmitted to and then received by the Interaction Manager of the remote server. Again, it may be noted here that, in this particular example, the miss recorded by the laser system and results of the computer vision in the optical system are actively transmitted to the remote server, even though various examples may be configured to not transmit such data as both engagement systems effectively recorded misses. At 640, the laser system data may be sent directly to the Engagement Adjudication Service, while the optical engagement system data and location and orientation data from the geometric pairing system may be sent to the Target Reconciliation Service. At 650, the Target Reconciliation Service may use the data on the location and orientation of the firearm to probabilistically identify one the simulation participants as the target of the engagement. At 660, the Hit Adjudication Service may simulate an ammunition round and determine that the round will hit the identified target. At 670, the Engagement Adjudication Service receives the hit determination from the Hit Adjudication Service. At 680, the Engagement Adjudication Service may determine the type of engagement that the participants were involved in when the data from the engagement systems was generated. For this particular example, it may be assumed that the determined engagement type primarily uses results from the geometric pairing engagement system in determining the final outcome of the engagement. This may mean, for example, the engagement type is determined to be blind fire through concealment (case 6 of Table 1), where the target is fully occluded. Lastly at 690, the Engagement Adjudication Service determines the final outcome of the engagement is that the participant is hit, which reflects the results based on the geometric pairing engagement system, even if those results contradict the results from both the laser and optical engagement systems. This may produce the most accurate simulation of the corresponding live scenario, as the foliage occluding the participant would likely not protect the target from an ammunition round.

Figure 7:
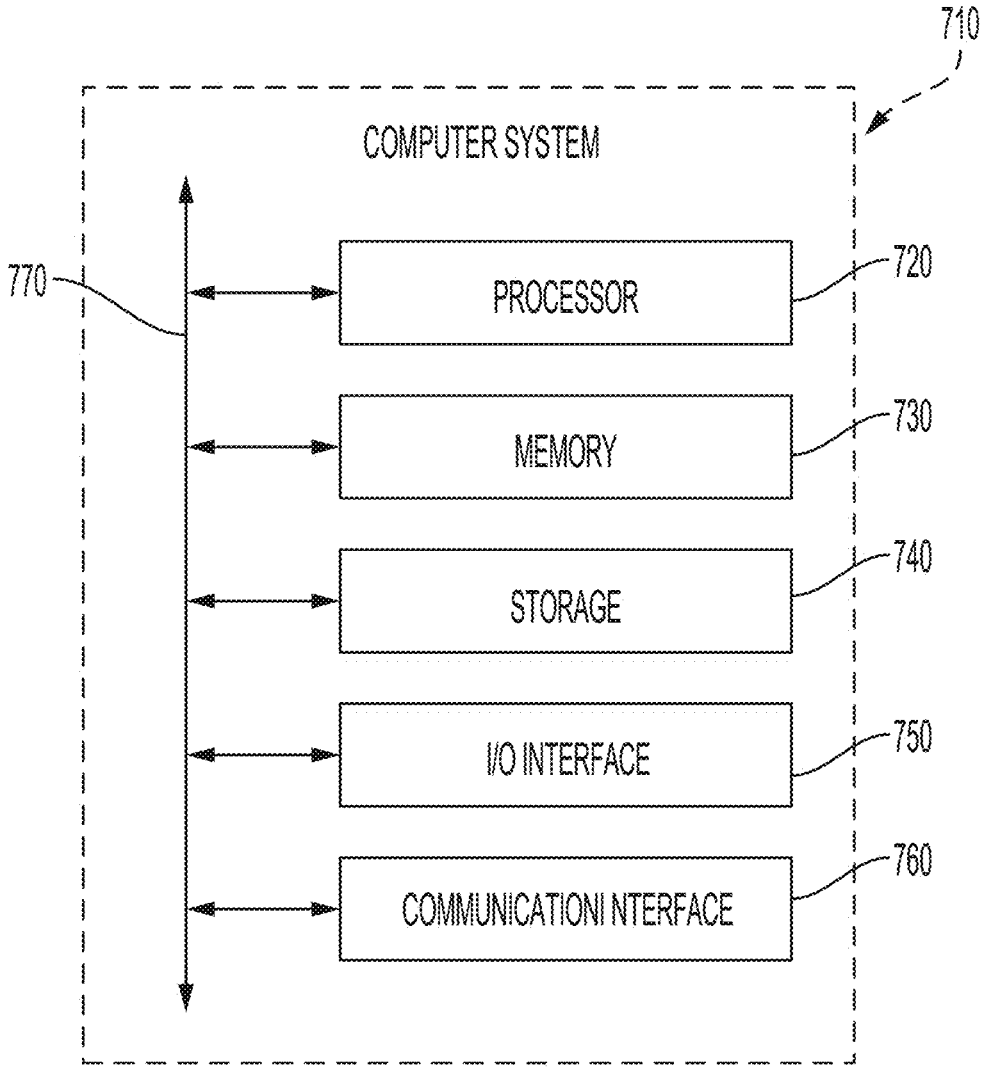
FIG. 7 illustrates an example computer system according to examples of the disclosure.

FIG. 7 illustrates an example computer system 710. In particular examples, one or more computer systems 710 perform one or more steps of one or more methods described or illustrated herein. In particular examples, one or more computer systems 710 provide functionality described or illustrated herein. In particular examples, software running on one or more computer systems 710 performs one or more steps of one or more methods described or illustrated herein or provides functionality described or illustrated herein. Particular examples include one or more portions of one or more computer systems 710. Herein, reference to a computer system may encompass a computing device, and vice versa, where appropriate. Moreover, reference to a computer system may encompass one or more computer systems, where appropriate.

This disclosure contemplates any suitable number of computer systems 710. This disclosure contemplates computer system 710 taking any suitable physical form. As example and not by way of limitation, computer system 710 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, a tablet computer system, or a combination of two or more of these. Where appropriate, computer system 710 may include one or more computer systems 710; be unitary or distributed; span multiple locations; span multiple machines; span multiple data centers; or reside in a cloud, which may include one or more cloud components in one or more networks. Where appropriate, one or more computer systems 710 may perform without substantial spatial or temporal limitation one or more steps of one or more methods described or illustrated herein. As an example and not by way of limitation, one or more computer systems 710 may perform in real time or in batch mode one or more steps of one or more methods described or illustrated herein. One or more computer systems 710 may perform at different times or at different locations one or more steps of one or more methods described or illustrated herein, where appropriate.

In particular examples, computer system 710 includes a processor 720, memory 730, storage 740, an input/output (I/O) interface 750, a communication interface 760, and a bus 770. Although this disclosure describes and illustrates a particular computer system having a particular number of particular components in a particular arrangement, this disclosure contemplates any suitable computer system having any suitable number of any suitable components in any suitable arrangement.

In particular examples, processor 720 includes hardware for executing instructions, such as those making up a computer program. As an example and not by way of limitation, to execute instructions, processor 720 may retrieve (or fetch) the instructions from an internal register, an internal cache, memory 730, or storage 740; decode and execute them; and then write one or more results to an internal register, an internal cache, memory 730, or storage 740. In particular examples, processor 720 may include one or more internal caches for data, instructions, or addresses. This disclosure contemplates processor 720 including any suitable number of any suitable internal caches, where appropriate. As an example and not by way of limitation, processor 720 may include one or more instruction caches, one or more data caches, and one or more translation lookaside buffers (TLBs). Instructions in the instruction caches may be copies of instructions in memory 730 or storage 740, and the instruction caches may speed up retrieval of those instructions by processor 720. Data in the data caches may be copies of data in memory 730 or storage 740 for instructions executing at processor 720 to operate on; the results of previous instructions executed at processor 720 for access by subsequent instructions executing at processor 720 or for writing to memory 730 or storage 740; or other suitable data. The data caches may speed up read or write operations by processor 720. The TLBs may speed up virtual-address translation for processor 720. In particular examples, processor 720 may include one or more internal registers for data, instructions, or addresses. This disclosure contemplates processor 720 including any suitable number of any suitable internal registers, where appropriate. Where appropriate, processor 720 may include one or more arithmetic logic units (ALUs); be a multi-core processor; or include one or more processors 720. Although this disclosure describes and illustrates a particular processor, this disclosure contemplates any suitable processor.

In particular examples, memory 730 includes main memory for storing instructions for processor 720 to execute or data for processor 720 to operate on. As an example and not by way of limitation, computer system 710 may load instructions from storage 740 or another source (such as, for example, another computer system 710) to memory 730. Processor 720 may then load the instructions from memory 730 to an internal register or internal cache. To execute the instructions, processor 720 may retrieve the instructions from the internal register or internal cache and decode them. During or after execution of the instructions, processor 720 may write one or more results (which may be intermediate or final results) to the internal register or internal cache. Processor 720 may then write one or more of those results to memory 730. In particular examples, processor 720 executes only instructions in one or more internal registers or internal caches or in memory 730 (as opposed to storage 740 or elsewhere) and operates only on data in one or more internal registers or internal caches or in memory 730 (as opposed to storage 740 or elsewhere). One or more memory buses (which may each include an address bus and a data bus) may couple processor 720 to memory 730. Bus 770 may include one or more memory buses, as described below. In particular examples, one or more memory management units (MMUs) reside between processor 720 and memory 730 and facilitate accesses to memory 730 requested by processor 720. In particular examples, memory 730 includes random access memory (RAM). This RAM may be volatile memory, where appropriate Where appropriate, this RAM may be dynamic RAM (DRAM) or static RAM (SRAM). Moreover, where appropriate, this RAM may be single-ported or multi-ported RAM. This disclosure contemplates any suitable RAM. Memory 730 may include one or more memories 730, where appropriate. Although this disclosure describes and illustrates particular memory, this disclosure contemplates any suitable memory.

In particular examples, storage 740 includes mass storage for data or instructions. As an example and not by way of limitation, storage 740 may include a hard disk drive (HDD), a floppy disk drive, flash memory, an optical disc, a magneto-optical disc, magnetic tape, or a Universal Serial Bus (USB) drive or a combination of two or more of these. Storage 740 may include removable or non-removable (or fixed) media, where appropriate. Storage 740 may be internal or external to computer system 710, where appropriate. In particular examples, storage 740 is non-volatile, solid-state memory. In particular examples, storage 740 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. This disclosure contemplates mass storage 740 taking any suitable physical form. Storage 740 may include one or more storage control units facilitating communication between processor 720 and storage 740, where appropriate. Where appropriate, storage 740 may include one or more storages 740. Although this disclosure describes and illustrates particular storage, this disclosure contemplates any suitable storage.

In particular examples, I/O interface 750 includes hardware, software, or both, providing one or more interfaces for communication between computer system 710 and one or more I/O devices. Computer system 710 may include one or more of these I/O devices, where appropriate. One or more of these I/O devices may enable communication between a person and computer system 710. As an example and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these. An I/O device may include one or more sensors. This disclosure contemplates any suitable I/O devices and any suitable I/O interfaces 750 for them. Where appropriate, I/O interface 750 may include one or more device or software drivers enabling processor 720 to drive one or more of these I/O devices. I/O interface 750 may include one or more I/O interfaces 750, where appropriate. Although this disclosure describes and illustrates a particular I/O interface, this disclosure contemplates any suitable I/O interface.

In particular examples, communication interface 760 includes hardware, software, or both providing one or more interfaces for communication (such as, for example, packet-based communication) between computer system 710 and one or more other computer systems 710 or one or more networks. As an example and not by way of limitation, communication interface 760 may include a network interface controller (NIC) or network adapter for communicating with an Ethernet or other wire-based network or a wireless NIC (WNIC) or wireless adapter for communicating with a wireless network, such as a WI-FI network. This disclosure contemplates any suitable network and any suitable communication interface 760 for it. As an example and not by way of limitation, computer system 710 may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, computer system 710 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), or other suitable wireless network or a combination of two or more of these. Computer system 710 may include any suitable communication interface 760 for any of these networks, where appropriate. Communication interface 760 may include one or more communication interfaces 760, where appropriate. Although this disclosure describes and illustrates a particular communication interface, this disclosure contemplates any suitable communication interface.

In particular examples, bus 770 includes hardware, software, or both coupling components of computer system 710 to each other. As an example and not by way of limitation, bus 770 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination of two or more of these. Bus 770 may include one or more buses 770, where appropriate. Although this disclosure describes and illustrates a particular bus, this disclosure contemplates any suitable bus or interconnect.

Herein, a computer-readable non-transitory storage medium or media may include one or more semiconductor-based or other integrated circuits (ICs) (such, as for example, field-programmable gate arrays (FPGAs) or application-specific ICs (ASICs)), hard disk drives (HDDs), hybrid hard drives (HHDs), optical discs, optical disc drives (ODDs), magneto-optical discs, magneto-optical drives, floppy diskettes, floppy disk drives (FDDs), magnetic tapes, solid-state drives (SSDs), RAM-drives, SECURE DIGITAL cards or drives, any other suitable computer-readable non-transitory storage media, or any suitable combination of two or more of these, where appropriate. A computer-readable non-transitory storage medium may be volatile, non-volatile, or a combination of volatile and non-volatile, where appropriate.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example examples described or illustrated herein that a person having ordinary skill in the art would comprehend. The scope of this disclosure is not limited to the example examples described or illustrated herein. Moreover, although this disclosure describes and illustrates respective examples herein as including particular components, elements, feature, functions, operations, or steps, any of these examples may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular examples as providing particular advantages, particular examples may provide none, some, or all of these advantages.

The invention claimed is:

1. A simulation system for executing a simulation of a tactical engagement, the simulation system comprising:

a plurality of firearms, each firearm associated with one participant of a plurality of participants in the simulation and comprising a laser device and an image capture device;

a plurality of laser sensors worn by the plurality of participants in the simulation;

a plurality of alarm devices worn by the plurality of participants in the simulation and connected to the plurality of laser sensors; and a computing system comprising a memory and one or more processors;

wherein the memory stores one or more programs that when executed by the one or more processors, cause the one or more processors to:

receive a first set of data from a laser sensor of the plurality of laser sensors worn by one of the plurality of participants in the simulation, wherein the first set of data comprises an indication that the laser sensor was struck by a laser transmitted from a firearm of the plurality of firearms;

receive a second set of data from the firearm of the plurality of firearms where the laser was transmitted from, wherein the second set of data comprises data generated by an image capture device of the firearm, wherein the data includes an indication that one or more of the plurality of participants are present in the data;

retrieve, from a data storage, a third set of data comprising position information and velocity information on the one or more of the plurality of participants that are present in the second set of data;

identify a target participant from the one or more of the plurality of participants identified in the second set of data, wherein identifying the target participant is based on the third set of data;

determine whether the target participant is struck by a simulated ammunition round fired from the firearm, wherein the determination is based on the third set of data; and determine a final outcome for the tactical engagement, wherein the determination is based on comparing the indication that the laser sensor was struck by the laser and the determination on whether the target participant is struck by the simulated ammunition round to one another and determining which is most accurate for a predefined scenario that the tactical engagement is in.

2. The system of claim 1, wherein the one or more programs when executed further cause the one or more processors to receive a fourth set of data comprising position information and orientation information of the firearm.

3. The system of claim 2, wherein the target participant is identified from the plurality of participants in the simulation using the third set of data and the fourth set of data, wherein the third set of data comprises position information and velocity information on each of the plurality of participants in the simulation.

4. The system of claim 3, wherein identifying the target participant from the plurality of participants comprises identifying one of the plurality of participants with a highest probability of being the target participant based on the third set of data and the fourth set of data.

5. The system of claim 3, wherein the one or more programs when executed further cause the one or more processors to make a second determination on whether the target participant is struck by the simulated ammunition round is based on a stochastic process using the third and fourth set of data to determine a likelihood that the target participant is struck by the simulated ammunition round.

6. The system of claim 5, wherein the final outcome of the tactical engagement is determined by determining a first likelihood that the laser sensor being struck by the laser is a correct outcome for the predefined scenario that the tactical engagement is in, a second likelihood that the determination of whether the target participant is struck by the simulated ammunition round is the correct outcome for the predefined scenario, and a third likelihood that the second determination of whether the target participant is struck by the simulated ammunition round is the correct outcome for the predefined scenario, wherein the final outcome is determined based on which of the first and second likelihoods is greater.

7. The system of claim 6, wherein a first set of steps used to determine the first likelihood, a second set of steps used to determine the second likelihood, and a third set of steps used to determine the third likelihood are stored into the data storage.

8. The system of claim 1, wherein the final outcome of the tactical engagement is stored into the data storage.

9. The system of claim 1, wherein the determination of whether the target participant is struck by the simulated ammunition round fired from the firearm is stored into the data storage.

10. The system of claim 1, wherein the one or more programs when executed further cause the one or more processors to determine an amount of damage done to the target participant if the target participant is determined to be struck by the simulated ammunition round.

11. The system of claim 1, wherein the simulated ammunition round is simulated by determining a trajectory of a live round when fired from the firearm.

12. The system of claim 1, wherein the first set of data further comprises information on when the laser was transmitted from the firearm.

13. The system of claim 1, wherein the first set of data further comprises information that identifies the firearm where the laser was transmitted from.

14. The system of claim 1, wherein the first set of data further comprises information on where the laser sensor is located on the body of the one of the plurality of participants.

15. The system of claim 1, wherein the one or more programs when executed further cause the one or more processors to periodically receive data about each of the plurality of participants.

16. The system of claim 15, wherein the received data about each of the plurality of participants is stored into the data storage.

17. The system of claim 1, wherein the one or more programs when executed further cause the one or more processors to transmit the final outcome to one or more of the plurality of participants.

18. The system of claim 1, wherein the indication, of the second set of data, that one or more of the plurality of participants are present in the data is determined by using computer vision.

19. The system of claim 1, wherein the second set of data comprises data generated by a passive sensor.

20. The system of claim 1, wherein identifying the target participant is further based on the first set of data.

21. A method for executing a simulation of a tactical engagement, the method comprising:

receiving a first set of data from a laser sensor of a plurality of laser sensors worn by one of a plurality of participants in the simulation, wherein the first set of data comprises an indication that the laser sensor was struck by a laser transmitted from a firearm of a plurality of firearms;

receiving a second set of data from the firearm of the plurality of firearms where the laser was transmitted from, wherein the second set of data comprises data generated by an image capture device of the firearm, wherein the data includes an indication that one or more of the plurality of participants are present in the data;

retrieving, from a data storage, a third set of data comprising position information and velocity information on the one or more of the plurality of participants that are present in the second set of data;

identifying a target participant from the one or more of the plurality of participants identified in the second set of data, wherein identifying the target participant is based on the third set of data;

determining whether the target participant is struck by a simulated ammunition round fired from the firearm, wherein the determination is based on the third set of data; and determining a final outcome for the tactical engagement, wherein the determination is based on comparing the indication that the laser sensor was struck by the laser and the determination on whether the target participant is struck by the simulated ammunition round to one another and determining which is most accurate for a predefined scenario that the tactical engagement is in.

22. A non-transitory computer readable storage medium storing one or more programs for executing a simulation of a tactical engagement, the programs for execution by one or more processors of a remote computing device that when executed by the device, cause the device to:

receive a first set of data from a laser sensor of a plurality of laser sensors worn by one of a plurality of participants in the simulation, wherein the first set of data comprises an indication that the laser sensor was struck by a laser transmitted from a firearm of a plurality of firearms;

receive a second set of data from the firearm of the plurality of firearms where the laser was transmitted from, wherein the second set of data comprises data generated by an image capture device of the firearm, wherein the data includes an indication that one or more of the plurality of participants are present in the data;

retrieve, from a data storage, a third set of data comprising position information and velocity information on the one or more of the plurality of participants that are present in the second set of data;

identify a target participant from the one or more of the plurality of participants identified in the second set of data, wherein identifying the target participant is based on the third set of data;

determine whether the target participant is struck by a simulated ammunition round fired from the firearm, wherein the determination is based on the third set of data; and determine a final outcome for the tactical engagement, wherein the determination is based on comparing the indication that the laser sensor was struck by the laser and the determination on whether the target participant is struck by the simulated ammunition round to one another and determining which is most accurate for a predefined scenario that the tactical engagement is in.

* * * * *